US005394571A

United States Patent [19]

Vernon

[11] Patent Number: 5,394,571

[45] Date of Patent: Mar. 7, 1995

[54] INFLATABLE BEDPAN WITH DISPOSABLE LINER

[76] Inventor: Susan N. Vernon, 8711 Mary Lee La., Annadale, Va. 22003

[21] Appl. No.: 299,555

[22] Filed: Sep. 1, 1994

[51] Int. Cl.[6] ..... A61G 9/00

[52] U.S. Cl. ..... 4/452; 4/456; 4/450

[58] Field of Search ..... 4/450, 451, 452, 453, 4/454, 455, 456, 457, 484

[56] References Cited

U.S. PATENT DOCUMENTS

| | | | |
|---|---|---|---|
| 3,061,840 | 11/1962 | Presseiseu | 4/451 |
| 3,383,712 | 5/1968 | Grant | 4/452 |
| 3,484,874 | 12/1969 | Bickenheuser, Jr. | 4/112 |
| 3,605,127 | 9/1971 | Dailey | 4/112 |
| 3,609,771 | 10/1971 | Avoy | 4/456 |
| 3,628,197 | 12/1971 | Leventhal et al. | 4/451 |
| 3,848,274 | 11/1974 | Oliver | 4/113 |
| 4,296,506 | 10/1981 | Stoute, Sr. et al. | 4/452 |
| 4,437,195 | 3/1984 | Mangels | 4/456 |
| 4,504,989 | 3/1985 | Maltz | 5/455 |
| 4,882,794 | 11/1989 | Stewart, III | 4/451 |
| 4,899,399 | 2/1990 | Young | 4/451 |
| 4,947,493 | 8/1990 | Salonica | 4/476 |
| 5,062,165 | 11/1991 | Kerr | 4/480 |
| 5,129,111 | 7/1992 | Feinzilberg et al. | 4/484 |
| 5,193,232 | 3/1993 | Flood et al. | 4/456 |
| 5,224,223 | 7/1993 | Royal | 4/451 |

FOREIGN PATENT DOCUMENTS

| | | | |
|---|---|---|---|
| 1468917 | 2/1967 | France | 4/484 |

*Primary Examiner*—Henry J. Recla
*Assistant Examiner*—Charles R. Eloshway
*Attorney, Agent, or Firm*—Raymond L. Greene

[57] ABSTRACT

An inflatable bedpan assembly having an inflatable horseshoe-shaped seat and a detachable waste collection bag which is sealed by use of a drawstring is provided. The bedpan is almost flat in its deflated condition and has a shape similar to a thick toilet seat when inflated. A waste collection bag substitutes for the bowl in a regular toilet. The bag is inserted prior to use, then is pulled out through a gap in the front of the seat. The bag closes and seals as it is pulled out. The collection bag is attached to the bedpan by means of a sleeve which is around the opening of the bag and which contains a drawstring. The sleeve containing the drawstring is wedged into a groove or channel formed around the inner circumference of the seat just below the top surface. After use, the drawstring and sleeve, with the suspended collection bag, are pulled out of the groove in the horseshoe and removed through the front gap.

6 Claims, 2 Drawing Sheets

INFLATABLE BEDPAN WITH DISPOSABLE LINER

FIELD OF THE INVENTION

The present invention relates generally to the field of inflatable bedpans and in particular, to bedpans having disposable liners.

BACKGROUND OF THE INVENTION

The typical conventional bedpan, made of plastic or a coated metal, is rigid, and even though it is shaped to some extent to conform to the body, at best it is always uncomfortable. In many cases a rigid bedpan is painful, especially where the patient is thin or has bed sores, is bruised, or otherwise injured. In some cases, long term use of rigid bedpans will cause bed sores. Conventional bedpans, suffer from numerous drawbacks: they are uncomfortable and sometimes harmful to sit or lie on; the motion of getting on them can be both painful and injurious; the lifting requirements can be physically stressful if not impossible for attendants, particularly a home care-taker; and disposal of the contents is unpleasant and unsanitary.

If a patient is paralyzed, experiences pain on moving, or is simply weak, more than one attendant may be required to lift the patient's hips high enough to allow insertion of the bedpan under the buttocks. Alternatively, the attendants may turn him on his side before placing the bedpan and then rotate him back on to the bedpan. Either of these procedures may cause extreme discomfort, or even further injury to patients who have fractures of the spine, pelvis, hips or upper legs and being lifted can be excruciating for patients with bone cancer. The movement also can be harmful if the patient has internal injuries, which in an emergency room, may not yet have been identified.

Use of the rigid bedpan is also very demanding of the attendants, more than one of whom is often required. Because they must lean over the bed, back muscles are used and consequently must be exceptionally strong to avoid injury to the attendant. Patients who might otherwise be cared for at home are often placed in nursing homes because family members are unable to meet the lifting requirements. This alternative not only increases health care costs but is terribly demoralizing for both the patient and family.

Disposing of the waste in the conventional bedpan is aesthetically unpleasant, not only because of the sight and smell, but because flushing of the contaminated contents often results in splashing.

The significance of the problem is attested by the many patents on inflatable bedpans, the earliest, having been awarded in 1915. Many of these patents address primarily issues of comfort and reduced lifting. These include U.S. Pat. No. 1,132,056 to Wesley; 2,466,142 to Yost; 3,008,153 to Coulter; 3,464,066 to Marks; 3,628,197 to Leventhal; 3,848,274 To Oliver; 5,224,223 to Royal; and 3,609,771 to Avoy. The last also teaches a disposable waste collector, however the collector cannot be closed and exposes the attendant to its contents. Some address methods of inflation, including U.S. Pat. No. 3513488 to Oring, 3546717 and 3571654 to Kuhn. One, U.S. Pat. No. 2750600 to MacDonald, addresses not only the comfort and lifting issues but also waste evacuation via a tube; highly unsanitary by today's standards. Many teach bedpans which are totally disposable, and consequently more expensive. Examples are U.S. Pat. No. 3,418,663 to Scott; 3,605,128 to Odin; 4,437,195 to Mangels; 4,899,399 to Young; and 4,136,789 to Oberstein.

Conventional inflatable bedpans are relatively costly when the entire bedpan is disposable. In addition, the lack of ability to close or seal the waste collection container prior to removing the bedpan from beneath the patient results in an unsanitary operation.

SUMMARY OF THE INVENTION

Accordingly, it is an object of the present invention to provide a relatively more comfortable bedpan.

It is a further object of the invention to minimize both patient movement and attendant's lifting requirements during bedpan insertion and waste removal.

Another object of the present invention is to minimize attendant's exposure to waste materials.

The present invention attains the foregoing and additional objects by providing an inflatable bedpan comprising an inflatable tube assembly, horseshoe shaped in its inflated state with a center cavity, thereby providing a shape similar to a thick toilet seat with a gap in the front. A waste collection bag having a sleeve around its opening edge is provided. In the preferred embodiment, the waste collection bag has an absorbent inner liner and water repellant or water proof outer liner which extends to form the sleeve. The sleeve contains a semi-flexible plastic drawstring which, together with the sleeve, is placed in a groove around the inner circumference of the bedpan. The semi-rigid drawstring is held in the bedpan groove by a shaping of the groove. This shaping causes the drawstring to be released from the groove by gradual separation beginning at the rear of the bedpan. The semi-rigid nature of the drawstring, in combination with the controlled separation from the bedpan, provides a support for the sleeve of the waste collection bag.

The waste collection bag is placed in the horseshoe-shaped seat when the seat is either deflated or inflated. One or more straps of material can be attached across the gap thereby joining the ends of the horseshoe. The deflated bedpan is placed beneath the patient and then pressurized via a nozzle. The inflating medium, either air, gas, or water, is released either via the same nozzle or alternately by another deflating nozzle. As the inflating medium fills the tube, the patient is raised and a cavity is formed in the center portion of the horseshoe tube with the waste collection bag in place.

Additional objects, advantages and novel features of the invention will be set forth in part in the description which follows, and in part will become apparent to those skilled in the art upon examination of the following or may be learned by practice of the invention. The object and advantages of the invention may be realized and attained by means of instrumentalities and combination particularly pointed out in the appended claims.

BRIEF DESCRIPTION OF THE DRAWINGS

The foregoing objects and advantages of the present invention will be more fully understood from the following detailed description and from reference to the appended drawings wherein.

DETAILED DESCRIPTION OF THE INVENTION

Figure 1:
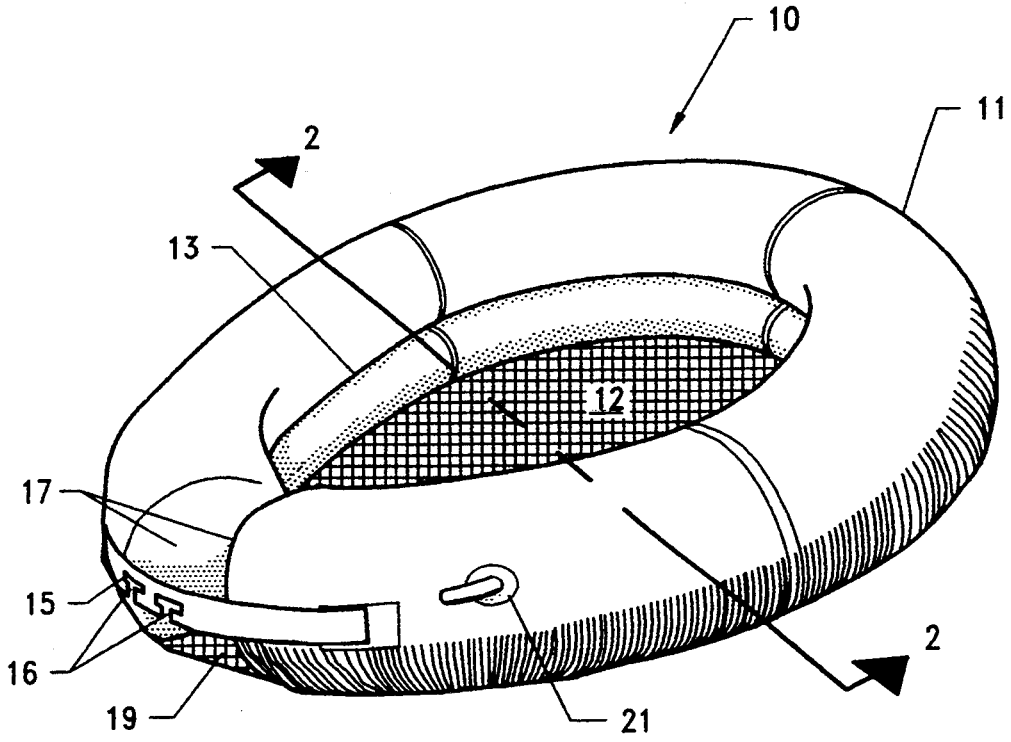
FIG. 1 is a perspective view of the inflated tube which forms the curved horseshoe-shaped inflated seat.

Referring now to FIG. 1, the inflatable bedpan, designated generally by the reference numeral 10, is shown with its major components. The inflatable tube assembly comprises an inflatable curved horseshoe-shaped tube 11, having a bottom surface forming an attached floor 12. A specially-shaped groove 13 is located on the upper portion of the inner circumference of the inflatable curved horseshoe-shaped tube 11. Strap 15 connects the ends 17 of the tube to maintain the stability and shape while leaving a gap 19 between the ends 17. Two notches 16 allow passage of a drawstring while providing support thereof. Valve stem 21 provides a means for inflating the bedpan. The bedpan valve stem 21 is adapted to allow inflation with different inflating media including air, pressurized gas, or water. In use, the bedpan is assembled and placed under the patient in the deflated condition, and then inflated. By this method, a minimum amount of lifting of the patient is necessary reducing the stress on both the attendant and the patient. Section 2—2 depicts the orientation of the sectional view of FIG. 2.

Figure 2:
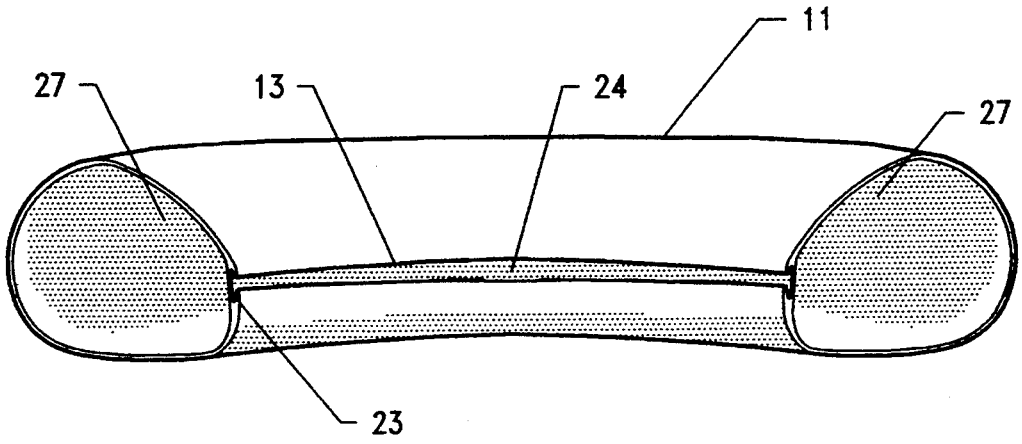
FIG. 2 is a cross-sectional view of the inflated tube at location 2—2 in FIG. 1.

Referring now to FIG. 2, a cross-sectional view of the inflatable curved horseshoe-shaped tube 11 illustrates the shaping of the specially-shaped groove 13. At the cross-section cut, the shape of the groove 13 provides a crimped over C-shape 23 thereby providing a snap-in attachment for the drawstring which is a semi-flexible material as later described. At the rear 24 of the horseshoe, however, the groove 13 widens at its opening providing an open C-shape, that is, without any crimping over. As a result, the drawstring when drawn out of the groove 13, first separates from the rear section of the horseshoe and then peels out of the groove from rear to front. Inflation of the horseshoe in cavity 27 provides sufficient support to maintain the shape of the groove 13.

Figure 3:
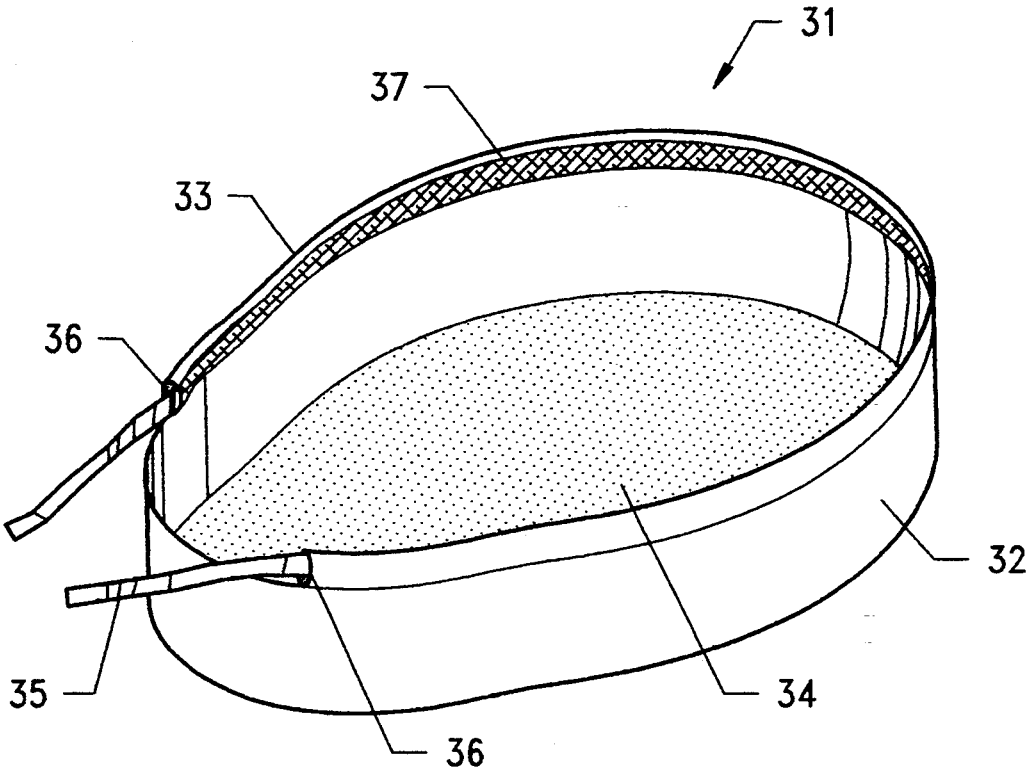
FIG. 3 is a perspective view of the waste collection bag.

The waste collection bag with the drawstring, a flattened plastic band, is further illustrated in FIG. 3. The gap 19, shown in FIG. 1, between the patient's legs allows waste collection bag 31 to be withdrawn. Waste collection bag 31 has an inner liner 34 of an absorbent, and thus splash resistant, material. Waste collection bag outer cover 32 is made of a waterproof or water repellant material, such as flexible plastic, and has a sleeve 33 which is a continuation of outer cover 32, and which contains drawstring 35. Drawstring 35, which is flexible in the horizontal plane but relatively rigid in the vertical plane comes out of the sleeve through slots 36 in sleeve 33 to extend through gap 19 in the horseshoe via notches 16 in strap 15. The flattened shape of the drawstring 35 provides resistance to bending downward as the drawstring is pulled out of groove 13 (shown in FIG. 1). In part, by this feature the upper edge of the waste collection bag remains approximately level with the groove 13 during sealing of the waste collection bag 31. The remaining support to the waste collection bag 31 is provided by the controlled release of the drawstring 35 from groove 13. The groove is widened at the rear section of the horseshoe and crimped at the sides and forward sections. As a result, separation of the drawstring-waste collection bag from the horseshoe begins at the rear section and then smoothly peels away from the horseshoe as the bag closes. Along the inner surface of the waste collection bag at the location of sleeve 33, an adhesive coating 37 is applied. As the bag closes, it seals the upper edges together thereby allowing the bag to be drawn out through gap 19 in the horseshoe without the need to remove the patient. The horseshoe can then be deflated and again with minimum stress to either patient or attendant, removed from beneath the patient. This procedure not only avoids the patient stress, but also provides a greatly improved handling of the waste. There is no need to attempt to lift the patient and simultaneously remove the entire bedpan and unsecured waste, a situation which requires multiple attendants and often results in waste spillage. Likewise, the inflated horseshoe having a floor will contain minor spills without soiling the patient's bedding.

Figure 4:
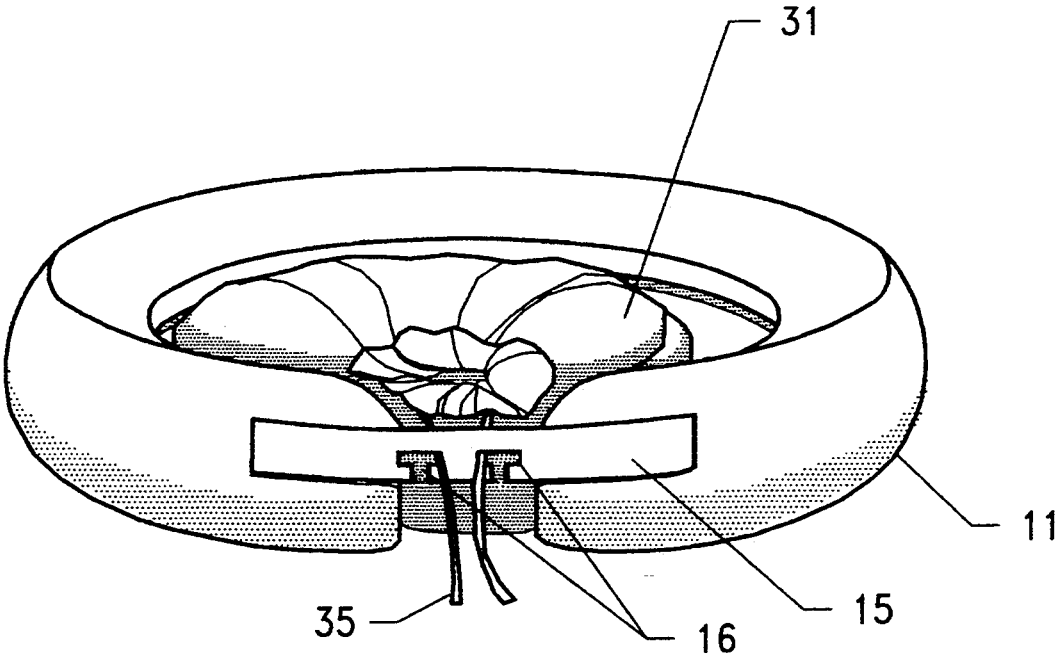
FIG. 4 is a perspective view of the inflated horseshoe tube after use and prior to waste collection bag removal.

FIG. 4 is a perspective front view of the inflated curved horseshoe-shaped tube 11 with waste collection bag 31. Drawstring 35 has been drawn to close the waste collection bag 31. The drawstring 35 extends through notches 16 in strap 15 thereby helping to maintain the bag in an upright position. The waste collection bag 31 can now be removed from beneath the patient by releasing the drawstring from notches 16 in strap 15. Strap 15 may be fixed or detachable at one end by VELCRO hook and loop fasteners connection to allow the ends of inflatable curved horseshoe-shaped tube 11 to spread apart. In either case, the horseshoe remains inflated and the patient remains in place during waste removal. Since the waste collection bag is closed the attendant is not exposed to the contents and the bag and drawstring can be disposed of.

The advantages of this invention are numerous. The bedpan may be inserted under and removed from the patient in a deflated form, thereby minimizing patient trauma and reducing the effort required by the attendant. The waste collection bag can be separated from the bedpan minimizing the replacement costs in comparison to fully disposable bedpans. The sealing systems of the collection bag allows closing and sealing prior to removal from the bedpan and prior to moving the patient. The drawstring, having a non-flexible feature in the perpendicular plane, supports the collection bag, thereby allowing sealing without moving the patient.

Although the invention has been described relative to a specific embodiment thereof, numerous variations and modifications will be readily apparent to those skilled in the art in the light of the above teachings.

What is claimed as new and desired to be secured by Letters Patent of the United States is:

1. An inflatable bedpan and liner assembly comprising:

a waste collection bag formed of flexible material having an opening at its top and a sleeve around the opening for receiving a drawstring;

a drawstring formed of semi-flexible material, said drawstring being inserted into the sleeve of said waste collection bag;

an inflatable tube assembly having a curved horseshoe shape defining a gap at a front portion of said tube assembly between opposing ends thereof, said tube assembly further having an inner circumference and a groove around the inner circumference;

said drawstring of said bag adapted to be received in, and detachable from, said groove such that said bag is held open during use of said bedpan when said drawstring is received in said groove, said drawstring pulling said bag closed when detached from said groove.

2. An inflatable bedpan and liner assembly as recited in claim 1 wherein said inflatable tube assembly further comprises a strap of material which extend across the gap thereby connecting the opposing ends of said tube.

3. An inflatable bedpan and liner assembly as recited in claim 1 wherein the groove in said inflatable tube forms a C-shape having a crimped over shape from adjacent the opposing ends of said horseshoe to a location at a rear portion of the horseshoe and thereafter has an open C-shape along the rear portion of the horseshoe.

4. An inflatable bedpan and liner assembly as recited in claim 1 wherein said inflatable tube further comprises a bottom surface which extends across said tube forming a floor.

5. An inflatable bedpan and liner assembly as recited in claim 1 wherein said drawstring is flexible in one plane and rigid in a plane normal to said one plane.

6. An inflatable bedpan and liner assembly as recited in claim 1 wherein said waste collection bag a sleeve has an inner surface which is coated with an adhesive coating.

* * * * *